US008172390B2

(12) United States Patent
Uemura

(10) Patent No.: US 8,172,390 B2
(45) Date of Patent: May 8, 2012

(54) IMAGE FORMING DEVICE AND IMAGE FORMING METHOD

(75) Inventor: Hiroshi Uemura, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 508 days.

(21) Appl. No.: 12/409,970

(22) Filed: Mar. 24, 2009

(65) Prior Publication Data

US 2009/0245824 A1 Oct. 1, 2009

(30) Foreign Application Priority Data

Mar. 28, 2008 (JP) ..... 2008-086940

(51) Int. Cl.
*B41J 2/01* (2006.01)

(52) U.S. Cl. ..... 347/102; 347/19; 347/101; 347/103; 347/104; 347/105

(58) Field of Classification Search ..... 347/19, 347/101–105
See application file for complete search history.

(56) References Cited

U.S. PATENT DOCUMENTS

| | | | | |
|---|---|---|---|---|
| 6,463,674 | B1 * | 10/2002 | Meyers et al. | 34/304 |
| 6,854,842 | B2 * | 2/2005 | Martin et al. | 347/102 |
| 7,771,039 | B2 * | 8/2010 | Sakagami | 347/102 |
| 2004/0109054 | A1 * | 6/2004 | Martin et al. | 347/102 |
| 2005/0270355 | A1 * | 12/2005 | Sootome et al. | 347/104 |
| 2008/0204535 | A1 * | 8/2008 | Sakagami | 347/102 |
| 2009/0027472 | A1 * | 1/2009 | Sekiya | 347/102 |

FOREIGN PATENT DOCUMENTS

| | | | | |
|---|---|---|---|---|
| JP | 362032069 | A * | 2/1987 | 347/102 |
| JP | 11-207943 | A | 8/1999 | |
| JP | 2000-62282 | A | 2/2000 | |
| JP | 2001-301131 | A | 10/2001 | |
| JP | 2004-25814 | A | 1/2004 | |
| JP | 2004-203034 | A | 7/2004 | |
| JP | 2007-1078 | A | 1/2007 | |
| JP | 2007-111873 | A | 5/2007 | |

* cited by examiner

*Primary Examiner* — Ryan Lepisto
*Assistant Examiner* — Guy Anderson
(74) *Attorney, Agent, or Firm* — Birch, Stewart, Kolasch & Birch, LLP

(57) ABSTRACT

An image forming device that includes a first moisture amount derivation component, a drying component, a storage component, and a control component is provided. The storage component stores drying information, including information representing a pre-drying moisture amount previously derived by the first moisture amount derivation component, and a drying strength of the drying component at which a recording medium was dried when the previously derived pre-drying moisture amount was derived. The control component controls the drying strength of the drying component on the basis of the pre-drying moisture amount derived by the first moisture amount derivation component and the drying information stored by the storage component.

18 Claims, 9 Drawing Sheets

IMAGE FORMING DEVICE AND IMAGE FORMING METHOD

CROSS-REFERENCE TO RELATED APPLICATION

This application claims priority under 35 USC 119 from Japanese Patent Application No. 2008-086940, the disclosure of which is incorporated by reference herein.

BACKGROUND OF THE INVENTION

1. Field of the Invention

The present invention relates to an image forming device and an image forming method, and particularly relates to an image forming device and image forming method that apply liquid and form an image.

2. Description of the Related Art

Technologies relating to drying of liquids (inks, processing liquids and the like) are important in inkjet printing. As a technology relating to drying, Japanese Patent Application Laid-Open (JP-A) No. 2004-203034 has disclosed a technology that improves glossiness of an image in fixing processing, by drying excess moisture included in an ink.

Temperature and humidity inside a device vary with the influence of external air in which the device is placed and with ink amounts and paper types. In the technology disclosed in JP-A No. 2004-203034, the passage of a certain amount of time, depending on certain environmental conditions, printing conditions and drying conditions, is required from the start of printing until the temperature and humidity inside the device stabilize. Therefore, in practical applications, it is necessary to perform preparatory driving until the temperature and humidity are stable, and anything printed in this period becomes waste paper. This effect is relatively minor when printing large quantities of the same printed matter, but if printing details and paper types change frequently, for example, as in on-demand printing or variable printing, printing will finish before the temperature and humidity within the device are stable, and control of a drying section is not practically possible.

Moreover, a moisture amount that should actually be dried varies with an original moisture absorption amount of the paper, which depends on the weather of the day, and image density (which is to say ink amounts and processing liquid amounts). In addition, ease of drying varies with the type of paper. Therefore, it is necessary to carry out print tests beforehand in order to determine optimum temperature and humidity conditions for particular print data and environmental conditions.

Furthermore, it is thought to be necessary to carry out temperature and humidity measurements in the vicinity of a drying section, but measurement errors are likely to be caused by the influence of a hot wind from the drying section, a high-temperature heater or the like. Thus, temperature and humidity conditions may not always be accurately acquired.

JP-A No. 2007-111873 has disclosed a technology that enables an improvement of print quality at an aqueous varnish drying apparatus of a printer, by reliably performing drying of a varnish coating surface at an optimum temperature.

In the technology disclosed in JP-A No. 2007-111873, a paper face temperature reaches a target value that determines paper face drying conditions, provided ink and varnish amounts and the paper type are consistently at constant conditions. Ordinarily however, these conditions are variously changeable between print jobs. Therefore, in practical applications, it is necessary to perform print tests beforehand in order to determine the optimum paper face temperature condition.

JP-A No. 2000-62282 discloses a technology in which an occupancy ratio of regions with high print density levels is calculated from image data and, depending on whether or not this proportion reaches criterion values, output of a drying section is adjusted stepwise.

In the technology disclosed in JP-A No. 2000-62282, when a paper type or environmental conditions such as temperature and humidity or the like change, drying conditions change even if the image density is the same. Therefore, in order to determine the criterion values for setting the optimum output of the drying section for an image density, it is necessary to find conditions by test printing beforehand.

Against this technological background, if, for example, drying of a processing liquid is insufficient or subsequent ink coagulation is insufficient, failures in image formation occur, such as colorant floating because of a moisture layer at the paper surface and the like. If drying of an ink is insufficient, in a subsequent fixing process, image offsetting onto a fixing roller and/or a decrease in fixing strength (scraping or peeling) occur, and problems such as curl (warping) of the paper, cockling (ruffling) and the like arise.

On the other hand, if drying is excessive, problems such as cracking of images, damage to paper and the like occur, in addition to which electric power of the drying apparatus is wastefully consumed, which is inefficient. A drying apparatus accounts for a relatively large proportion of the power consumption of an inkjet printer. Therefore, inefficient drying leads to an increase in running costs.

With these conventional technologies, there has been a problem in that it is difficult to reliably dry liquids that are for forming images.

SUMMARY OF THE INVENTION

In consideration of the problems described above, an object of the present invention is to provide an image forming device and image forming method that enable accurate drying of a liquid for forming an image.

An aspect of the present invention is an image forming device including: a first moisture amount derivation component that derives a pre-drying moisture amount, which is a moisture amount contained in a recording medium after a liquid for forming an image has been applied by a liquid application component that applies the liquid to the recording medium; a drying component that dries the recording medium after the liquid has been applied to the recording medium by the liquid application component, a drying strength representing a degree of intensity with which the recording medium is dried being controlled; a storage component that stores drying information, including information representing a pre-drying moisture amount previously derived by the first moisture amount derivation component, and a drying strength of the drying component at which a recording medium was dried when the previously derived pre-drying moisture amount was derived; and a control component that controls the drying strength of the drying component on the basis of the pre-drying moisture amount derived by the first moisture amount derivation component and the drying information stored by the storage component.

Another aspect of the present invention is an image forming method including: (a) deriving a pre-drying moisture amount, which is a moisture amount contained in a recording medium after a liquid for forming an image has been applied by a liquid application component that applies the liquid to the recording medium; (b) drying the recording medium after the liquid has been applied by the liquid application component, a drying strength representing a degree of intensity with which the recording medium is dried being controlled; and (c) controlling the drying strength in (b) on the basis of drying information, which is stored by a storage component, including information representing a pre-drying moisture amount previously derived by the first moisture amount derivation component and a drying strength of the drying component at which a recording medium was dried when the previously derived pre-drying moisture amount was derived, and the pre-drying moisture amount derived by (a).

DETAILED DESCRIPTION OF THE INVENTION

Hereinafter, an exemplary embodiment of the present invention will be described in detail with reference to the drawings. In the present exemplary embodiment, a liquid is manifested as droplets. The meaning of the term "apply the liquid" includes jetting the liquid or coating with the liquid.

Firstly, overall structure of an image forming device 10 will be described.

—Image Forming Device—

Figure 1:
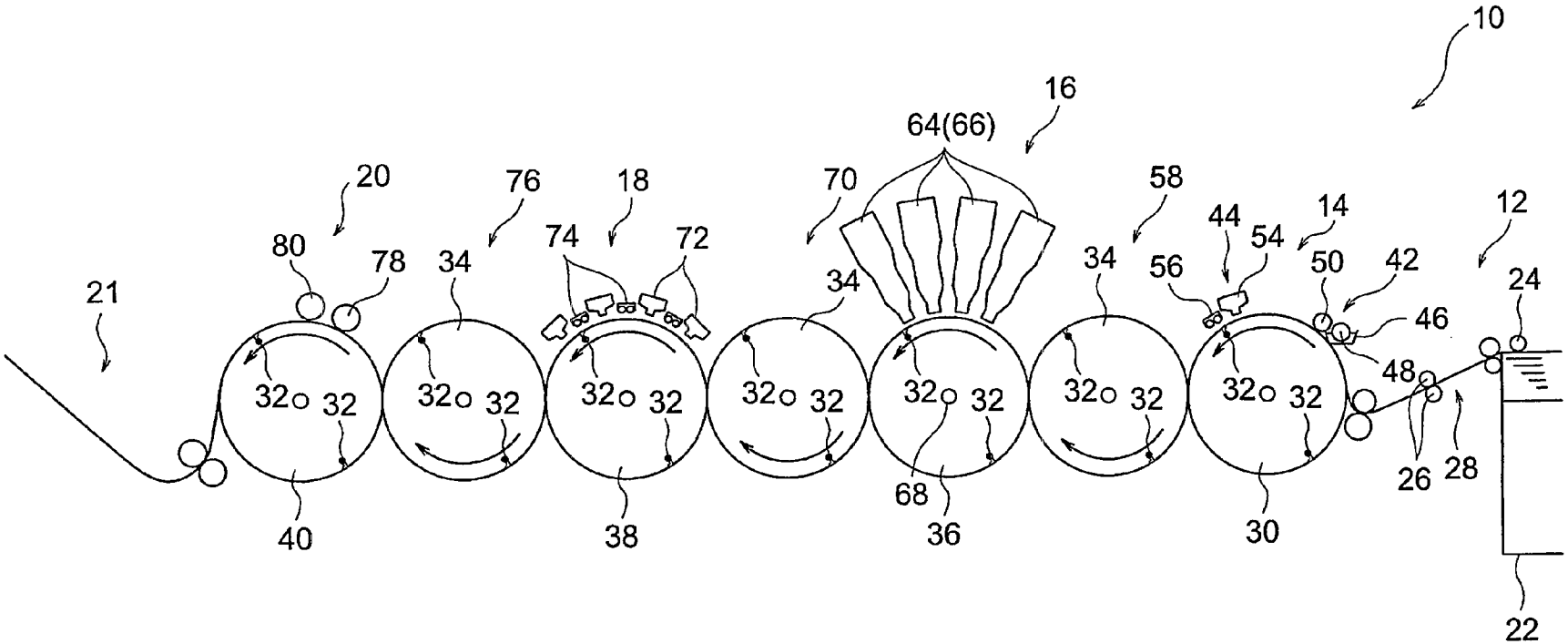
FIG. 1 is a diagram showing an image recording device relating to an exemplary embodiment of the present invention.

As shown in FIG. 1, the image forming device 10 relating to the present exemplary embodiment is provided with a paper supply conveyance section 12 that supplies and conveys sheet paper which serves as a recording medium (hereinafter referred to as paper), at an upstream side of a conveyance direction of the paper. Along the conveyance direction of the paper at the downstream side of the paper supply conveyance section 12, a processing liquid application section 14, an image forming section 16, an ink drying section 18, an image fixing section 20 and an ejection section 21 are provided. The processing liquid application section 14 applies a processing liquid to a recording face of the paper. The image forming section 16 forms an image on the recording face of the paper. The ink drying section 18 dries the image formed on the recording face. The image fixing section 20 fixes the dried image to the paper. The ejection section 21 ejects the paper to which the image has been fixed.

Each processing section is described herebelow.

—Paper Supply Conveyance Section—

The paper supply conveyance section 12 is provided with a stacking section 22, at which paper is stacked, and a paper supply section 24 at the paper conveyance direction downstream side of the stacking section 22 (hereinafter the term "paper conveyance direction" may be omitted). The paper supply section 24 supplies the paper stacked in the stacking section 22, one sheet at a time. The paper supplied by the paper supply section 24 passes through a conveyance section 28 structured with plural pairs of rollers 26, and is conveyed to the processing liquid application section 14.

—Processing Liquid Application Section—

At the processing liquid application section 14, a processing liquid application drum 30 is rotatably provided. Retention members 32 are provided at the processing liquid application drum 30. The retention members 32 nip distal end portions of the paper and retain the paper. In a state in which paper is retained at the surface of the processing liquid application drum 30, between the retention members 32, the paper is conveyed to the downstream side by rotation of the processing liquid application drum 30.

Similarly to the processing liquid application drum 30, the retention members 32 are also provided at an intermediate conveyance drum 34, an image forming drum 36, an ink drying drum 38 and a fixing drum 40, which are described later. Handovers of paper from upstream side drums to downstream side drums are implemented by the retention members 32.

At an upper portion of the processing liquid application drum 30, a processing liquid application apparatus 42 and a processing liquid drying apparatus 44 are disposed along the circumferential direction of the processing liquid application drum 30. Processing liquid is applied to the recording face of the paper by the processing liquid application apparatus 42, and the processing liquid is dried by the processing liquid drying apparatus 44.

This processing liquid will react with ink and coagulate a colorant (pigment), and has the effect of promoting separation of the colorant (pigment) from a solvent. A reservoir section 46, at which the processing liquid is stored, is provided at the processing liquid application apparatus 42. A portion of a gravure roller 48 is immersed in the processing liquid.

A rubber roller 50 is disposed to press against the gravure roller 48. The rubber roller 50 touches against the recording face (surface) of the paper and applies the processing liquid thereto. A squeegee touches against the gravure roller 48, and regulates processing liquid application amounts that are applied to the recording face of the paper.

Ideally, a processing liquid layer thickness is significantly smaller than droplets jetted from a head. For example, in a case of 2 pl droplet amounts, an average diameter of droplets jetted from a head is 15.6 μm. If the processing liquid layer thickness is too thick, ink dots will float in the processing liquid rather than making contact with the recording face of the paper. With 2 pl droplet amounts, it is preferable for the processing liquid layer thickness to be not more than 3 μm for impact dot diameters of 30 μm or above.

At the processing liquid drying apparatus 44, a hot wind nozzle 54 and an infrared heater 56 (below referred to as the IR heater 56) are disposed close to the surface of the processing liquid application drum 30. A solvent such as water or the like in the processing liquid is evaporated by the hot wind nozzle 54 and the IR heater 56, forming solids or a thin processing liquid layer at the recording face of the paper. Because the processing liquid is formed into a thin layer by this processing liquid drying process, dots of ink jetted by the image forming section 16 will come into contact with the paper surface and a required dot diameter will be obtained. In addition, the action of the ink reacting with the processing liquid formed into a thin layer and the colorant coagulating and being fixed to the paper surface is easily obtained.

Hence, the paper at whose recording face processing liquid has been applied and dried by the processing liquid application section 14 is conveyed to an intermediate conveyance section 58, which is disposed between the processing liquid application section 14 and the image forming section 16.

—Intermediate Conveyance Section—

At the intermediate conveyance section 58, the intermediate conveyance drum 34 is rotatably provided. The paper is retained at the surface of the intermediate conveyance drum 34, between the retention members 32 that are provided at the intermediate conveyance drum 34, and the paper is conveyed downstream by rotation of the intermediate conveyance drum 34.

—Image Forming Section—

At the image forming section 16, the image forming drum 36 is rotatably provided. The paper is retained at the surface of the image forming drum 36, between the retention members 32 that are provided at the image forming drum 36, and the paper is conveyed downstream by rotation of the image forming drum 36.

A head unit 66 is disposed close to the surface of the image forming drum 36 at an upper portion of the image forming drum 36. The head unit 66 is constituted with single pass-type inkjet line heads 64. In the head unit 66, at least inkjet line heads 64 of Y, M, C and K, which are the basic colors, are arranged along the circumferential direction of the image forming drum 36. The inkjet line heads 64 form an image of the respective colors on the processing liquid layer that has been formed at the recording face of the paper by the processing liquid application section 14.

The processing liquid provides an effect of coagulating colorant (pigment) and latex particles dispersed in the ink with the processing liquid, and forms coagulated bodies that will not result in colorant flowing on the paper or the like. An example of the reaction between the ink and the processing liquid is disrupting color pigment dispersion, by including an acid in the processing liquid and lowering the pH value, and using a coagulating mechanism to prevent droplet interference due to colorant spreading, color mixing between inks of the different colors and liquid mixing when the ink droplets are jetted.

Each inkjet line head 64 performs jetting synchronously with an encoder that senses a rotation speed, which is provided at the image forming drum 36. Thus, impact positions are determined with high accuracy, and impact variations may be reduced regardless of vibrations of the image forming drum 36, precision of a rotation axle 68 or drum surface speeds.

The head unit 66 may be capable of withdrawing from the upper portion of the image forming drum 36. Maintenance operations such as cleaning nozzle faces of the inkjet line heads 64, ejecting increased viscosity ink and the like are carried out when the head unit 66 has been withdrawn from the upper portion of the image forming drum 36.

The paper at whose recording face the image has been formed is conveyed to an intermediate conveyance section 70, which is disposed between the image forming section 16 and the ink drying section 18, by the rotation of the image forming drum 36. The intermediate conveyance section 70 has substantially the same structure as the intermediate conveyance section 58, so will not be described.

—Ink Drying Section—

At the ink drying section 18, the ink drying drum 38 is rotatably provided. At an upper portion of the ink drying drum 38, a hot wind nozzle 72 and an IR heater 74 are plurally disposed close to a surface of the ink drying section 18. At an image formation portion of the paper, solvent that has been separated by the colorant coagulation action is dried off by hot airflow from the hot wind nozzle 72 and IR heater 74, and a thin film image layer is formed.

The evaporated solvent is ejected outside the image forming device 10 together with air, and air is recovered. This air is cooled by a cooler, a radiator or the like and recovered as a liquid.

The paper at which the image on the recording face has been dried is conveyed to an intermediate conveyance section 76, which is disposed between the ink drying section 18 and the image fixing section 20, by the rotation of the ink drying drum 38. The intermediate conveyance section 76 has substantially the same structure as the intermediate conveyance section 58, so will not be described.

—Image Fixing Section—

At the image fixing section 20, the fixing drum 40 is rotatably provided. The image fixing section 20 features the function of heating/pressing and fusing latex particles in the thin-film image layer formed on the ink drying drum 38, and binding and fixing the same onto the paper.

At an upper portion of the fixing drum 40, a heating roller 78 is disposed close to the surface of the fixing drum 40. At this heating roller 78, a halogen lamp is inserted in a metal pipe of aluminium or the like that has good thermal conductivity. Heat energy to at least the glass transition temperature of the latex is provided by the heating roller 78. As a result, the latex particles fuse, fixing is implemented in which the latex is pushed into irregularities in the paper and the irregularities of the image surface are leveled, and it is possible to provide glossiness.

A fixing roller 80 is disposed downstream of the heating roller 78. The fixing roller 80 is disposed in a state of pressing against the surface of the fixing drum 40, and provides nipping force between the fixing roller 80 and the fixing drum 40. Accordingly, at least one of the fixing roller 80 and the fixing drum 40 has a resilient layer at the surface thereof and a structure with a uniform nipping width on the paper is formed.

After the processing described above, the paper to whose recording face the image has been fixed is conveyed to the ejection section 21, which is disposed downstream of the image fixing section 20, by the rotation of the fixing drum 40.

The image fixing section 20 has been described for this exemplary embodiment. However, it is sufficient if an image formed at a recording face by the ink drying section 18 can be dried and fixed. Therefore, the image fixing section 20 is not necessarily required.

Herebelow, details of image formation processing relating to the present exemplary embodiment are described. In the following descriptions, descriptions are not given for portions with reference numerals that have already been described. Moreover, in the following descriptions, a case in which the liquid for forming the image is an ink is described as an example. For a case in which the liquid is a processing liquid, the processing liquid application section 14 should be substituted for the image forming section 16 as the liquid application component and the processing liquid drying apparatus 44 should be substituted for the ink drying section 18 as the drying component. Of moisture meters 94 and 95 which are discussed below, the moisture meter 94, which serves as a first moisture amount derivation component, derives a moisture amount contained in the paper after the processing liquid has been applied by the processing liquid application section 14. The moisture meter 95, which serves as a second moisture amount derivation component, derives a post-drying moisture amount, which is a moisture amount contained in the paper that has been dried by the processing liquid drying apparatus 44.

Firstly, (first) image formation processing) is described. A structure when this (first) image formation processing is to be carried out is described using FIG. 2.

Figure 2:
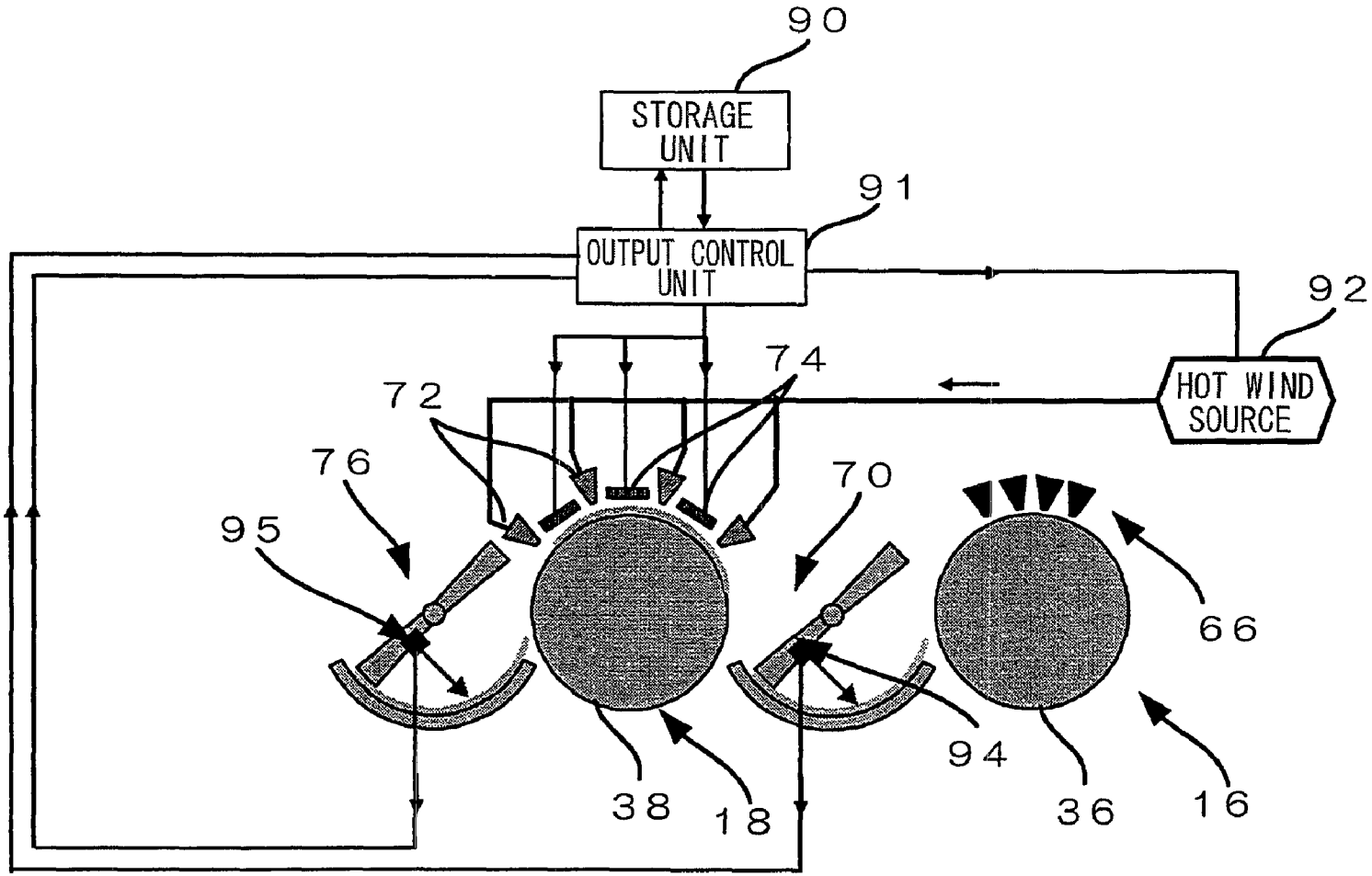
FIG. 2 is a diagram showing structure pertaining to (first) image formation processing relating to the exemplary embodiment of the present invention.

FIG. 2 is a diagram showing, of the structure described in FIG. 1, structure pertaining to the image formation processing relating to the present exemplary embodiment, a storage unit 90, an output control unit 91, a hot wind source 92, and the moisture meters 94 and 95.

Of these, the moisture meter 94 derives a pre-drying moisture amount, which is a moisture amount contained in the paper after ink has been jetted by the image forming section 16. The moisture meter 95 derives the post-drying moisture amount, which is a moisture amount contained in the paper that has been dried by the ink drying section 18.

In FIG. 2, both moisture meters illuminate infrared radiation at the paper for detecting the moisture amount contained in the paper, and detect the moisture amount contained in the paper with an infrared sensor or the like that measures the moisture in the paper from the reflected infrared light.

After droplets have been jetted at the paper, the hot wind nozzle 72 and IR heater 74 included at the ink drying section 18 dry the paper. Accordingly, a drying strength of the hot wind nozzle 72 and IR heater 74, which represents a degree of intensity to which the paper is dried, is controllable.

The storage unit 90 memorizes drying information, including information representing pre-drying moisture amounts previously derived by the moisture meter 94 and drying strengths of the ink drying section 18 at which the paper was dried when those pre-drying moisture amounts were derived. The storage unit 90 is a rewritable non-volatile memory device such as an HDD (hard disk drive) or the like. The drying strength is represented by a temperature of the IR heater 74 and a hot wind supply quantity from the hot wind nozzle 72. Information representing these is expressed as IR information and hot wind information, and together these are expressed as drying information.

The output control unit 91 controls the drying strength of the ink drying section 18 on the basis of the pre-drying moisture amount derived by the moisture meter 94 and the drying information memorized by the storage unit 90. This output control unit 91 is constituted with a CPU (central processing unit), an ASIC (application-specific integrated circuit) a ROM (read-only memory) at which a program and the like are stored and a RAM (random access memory), or the like.

The hot wind source 92 provides hot airflows to the hot wind nozzle 72 under the control of the output control unit 91.

Figure 3B:
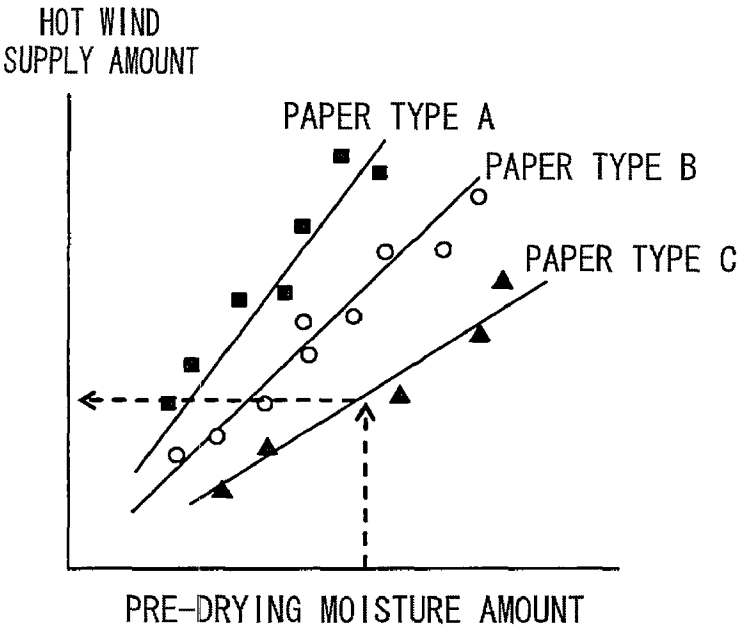
FIG. 3B is a chart showing hot wind information stored in the storage device.
Figure 3A:
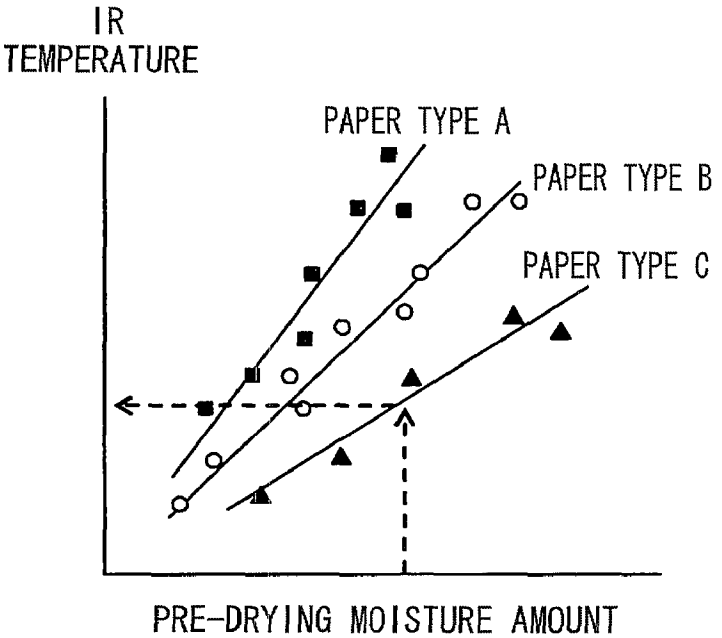
FIG. 3A is a chart showing IR information stored in a storage device.

FIG. 3A and FIG. 3B illustrate IR information and hot wind information stored at the storage unit 90. FIG. 3A shows an example of IR information that is stored at the storage unit 90 with pre-drying moisture amounts along the horizontal axis and IR temperatures along the vertical axis.

FIG. 3B shows an example of hot wind supply quantities stored at the storage unit 90 with pre-drying moisture amounts along the horizontal axis and hot wind supply quantities along the vertical axis. In both these graphs, paper types representing categories of paper (type information) are also represented. Therefore, if a type detection component that detects the type is provided at the structure of FIG. 2, more accurate IR temperatures and hot wind supply quantities are provided.

This type detection component may be, for example, a component that detects the type from a thickness of the paper and a condition of transmission of illuminated light, a component at which the type of the paper is specified by an operator, or the like. In any case, the type of the paper may be identified by the output control unit 91 and hence the output control unit 91 controls the drying strength of the ink drying section 18 on the basis of the detected type of paper, the pre-drying moisture amount derived by the moisture meter 94 and the drying information memorized by the storage device.

As shown in FIG. 3A and FIG. 3B, the IR information and the hot wind information are discrete. Therefore, the output control unit 91 derives an IR temperature and a hot wind supply quantity from the IR information and the hot wind information by linear interpolation or the like.

Further, the output control unit 91 controls the drying strength of the ink drying section 18 such that a post-drying moisture amount derived by the moisture meter 95 will be at a pre-specified moisture amount. This control is control to weaken the drying strength when the drying is excessive and intensify the drying strength when the drying is insufficient.

Flow of the (first) image formation processing described above will be described using the flowchart of FIG. 4.

Firstly, in step 101, a type of paper is detected by the aforementioned type detection component. In step 102, the paper is conveyed to the moisture meter 94. In step 103, a pre-drying moisture amount is derived by the moisture meter 94.

Then, in step 104, the output control unit 91 controls the drying strength on the basis of the pre-drying moisture amount and the above-described drying information. In step 105, a test print is performed.

Then, in step 106, a post-drying moisture amount is derived by the moisture meter 95. It is judged in step 107 whether or not this post-drying moisture amount is a pre-specified moisture amount. If this judgment is negative, then in step 108, the output control unit 91 controls the drying strength so as to go to the pre-specified moisture amount. In step 109, paper is again conveyed to the moisture meter 94, and the flow returns to the processing of step 105. Herein, the pre-specified moisture amount may be a pre-specified range of moisture amounts.

On the other hand, if the judgment of step 107 is positive, then in step 110, the actual print is performed. In step 111, information representing the pre-drying moisture amount, drying strength and type of paper for this case is stored in the storage unit 90, and the processing ends.

During the actual print in the processing described above, the post-drying moisture amount is continually monitored and the output control unit 91 controls the drying strength of the ink drying section 18 so as to be at the pre-specified moisture amount. Then, in step 111, an average value of the pre-drying moisture amount and an average value of the drying strength may be stored in the storage unit 90.

According to the (first) image formation processing described hereabove, because the drying strength of the ink drying section 18 may be controlled on the basis of the post-drying moisture amounts, even if there are differences in ink densities between images and the paper type variously changes, optimum drying conditions may be obtained. Therefore, problems associated with insufficient drying, such as image offsetting onto a fixing roller in a subsequent fixing process, a decrease in fixing strength (scraping and peeling), curling/cockling (ruffling) of the paper and the like, as well as problems due to excessive drying, such as cracking of the image and deterioration of the paper, may be avoided and print quality may be improved.

Because the drying strength of the ink drying section 18 may be prepared before a print commences on the basis of the pre-drying moisture amount and the past history, the likelihood of executing the actual print promptly is higher. Therefore, the generation of waste paper by printing before the actual print and the like may be reduced and, at the same time, the inconvenience for an operator of a condition-setting operation may be removed. This is particularly beneficial where numbers of printouts are in small quantities, such as in variable printing, on-demand printing or the like.

Moreover, the drying strength may be controlled to a minimum required with actual moisture amounts being monitored. Therefore, electricity is not wasted and a saving of energy of the device may be achieved. In such cases, because the output of a blower provided at the hot wind source 92 is kept to the minimum required, a reduction in noise may also be expected.

Figure 5:
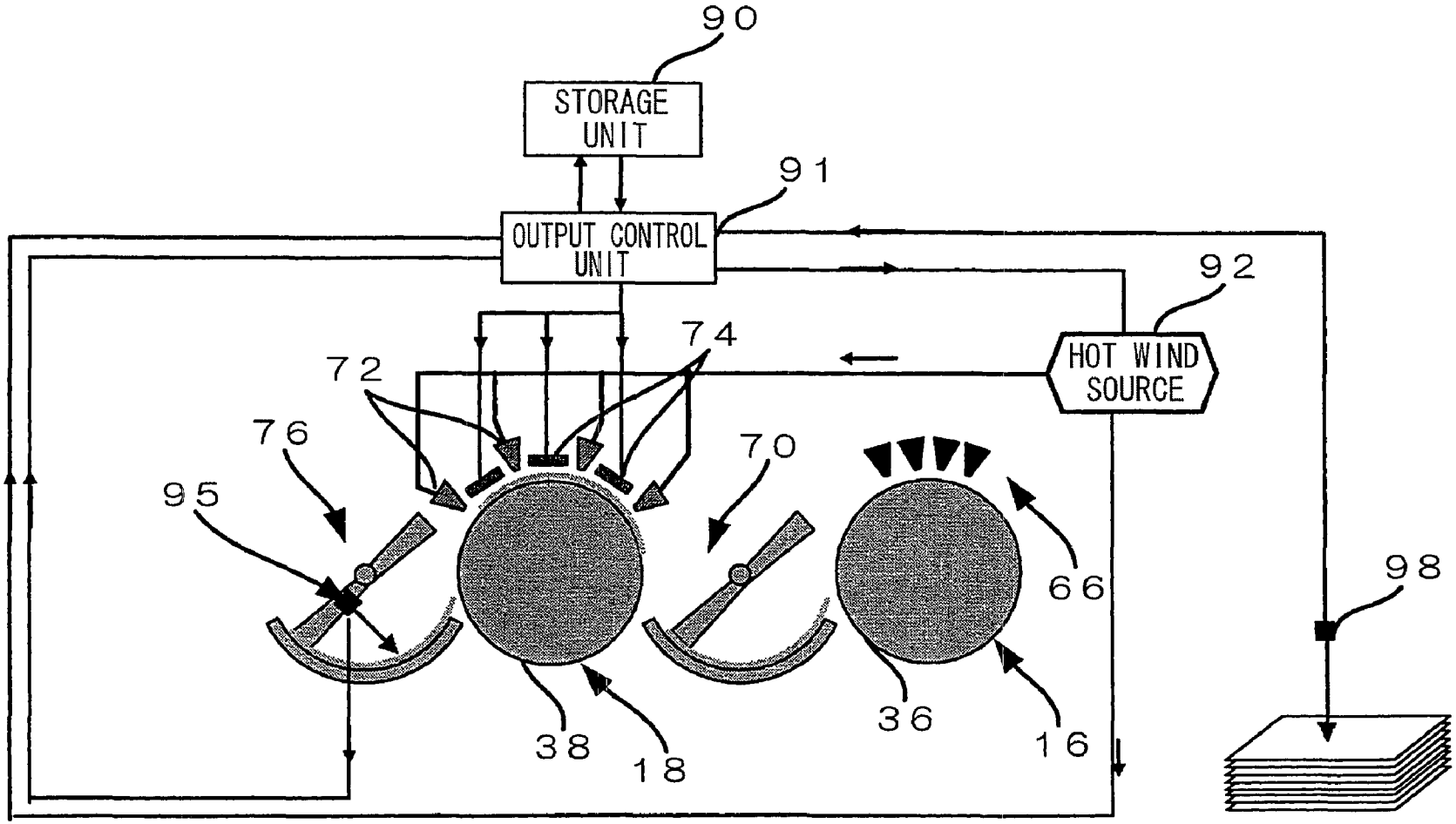
FIG. 5 is a diagram showing structure pertaining to (second) image formation processing relating to the exemplary embodiment of the present invention.

Next, another constitution of the image formation processing is described using FIG. 5. FIG. 5 is a structure in which the moisture meter 94 is removed from the structure shown in FIG. 2 and a moisture meter 98 is newly provided.

A (second) image formation processing that can be carried out with the above-described structures of FIG. 2 and FIG. 5 is described.

In the constitutions illustrated in FIG. 5 and FIG. 2, if the moisture contained in the paper is substantially constant or is small enough to be ignored relative to total amounts of droplets jetted at the paper by the image forming section 16, a pre-drying moisture amount contained in the paper may be derived from a total amount of droplets jetted at the paper by the image forming section 16 instead of the moisture meter 94 and moisture meter 98 being employed. In such a case, because these moisture meters are not required, costs of the device may be kept down.

Further, a pre-drying moisture amount contained in the paper may be derived more accurately by using as the pre-drying moisture amount a moisture amount that is obtained by adding a moisture amount obtained from the moisture meter 94 or the moisture meter 98 to the above-mentioned total amount of droplets.

Thus, according to the (second) image formation processing, the pre-drying moisture amount may be derived on the basis of one or both of: a moisture amount derived with a moisture meter that detects a moisture amount contained in the paper; and an amount of droplets jetted at the paper by the image forming section 16.

Figure 4:
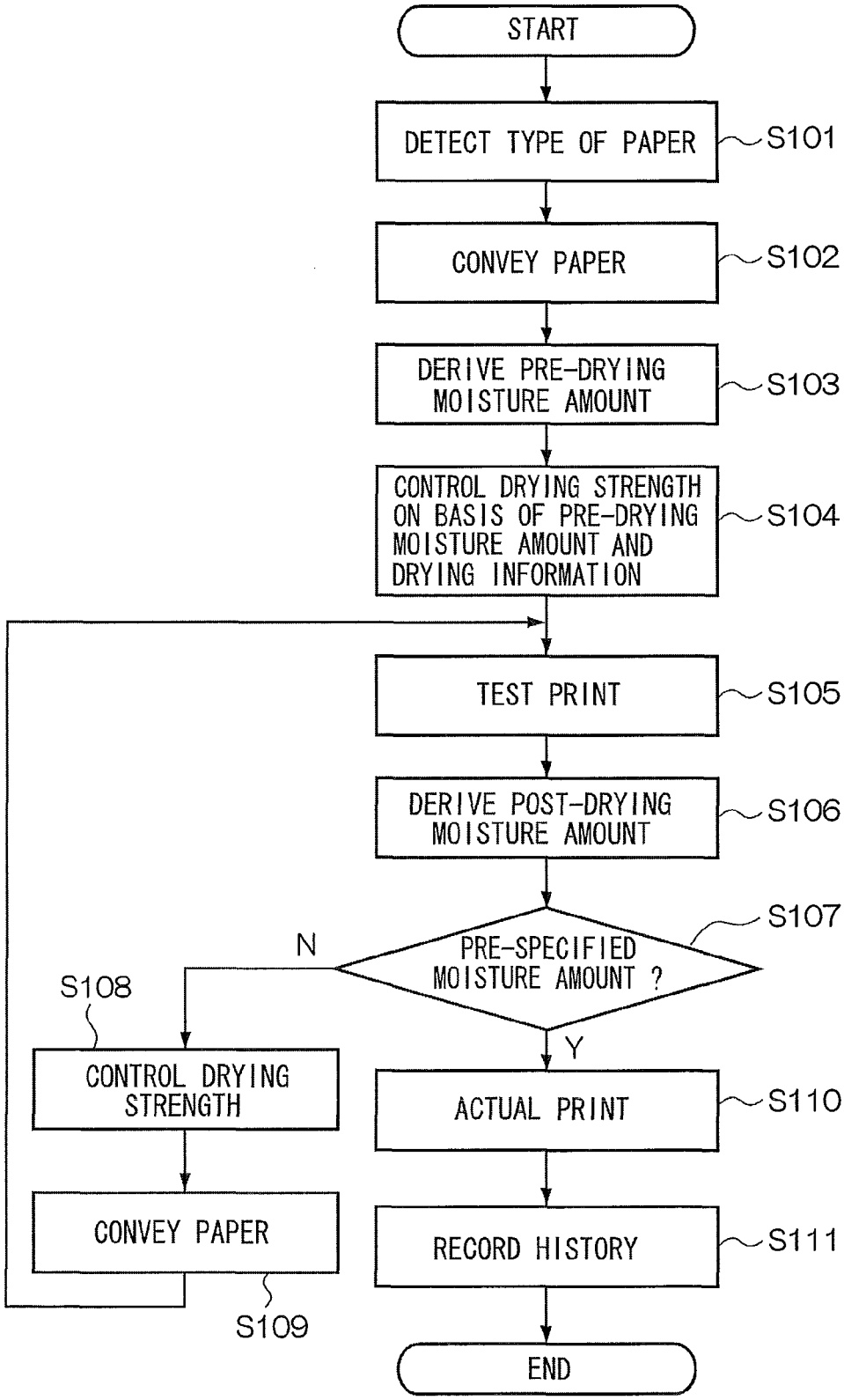
FIG. 4 is a flowchart showing the image formation processing.
Figure 6:
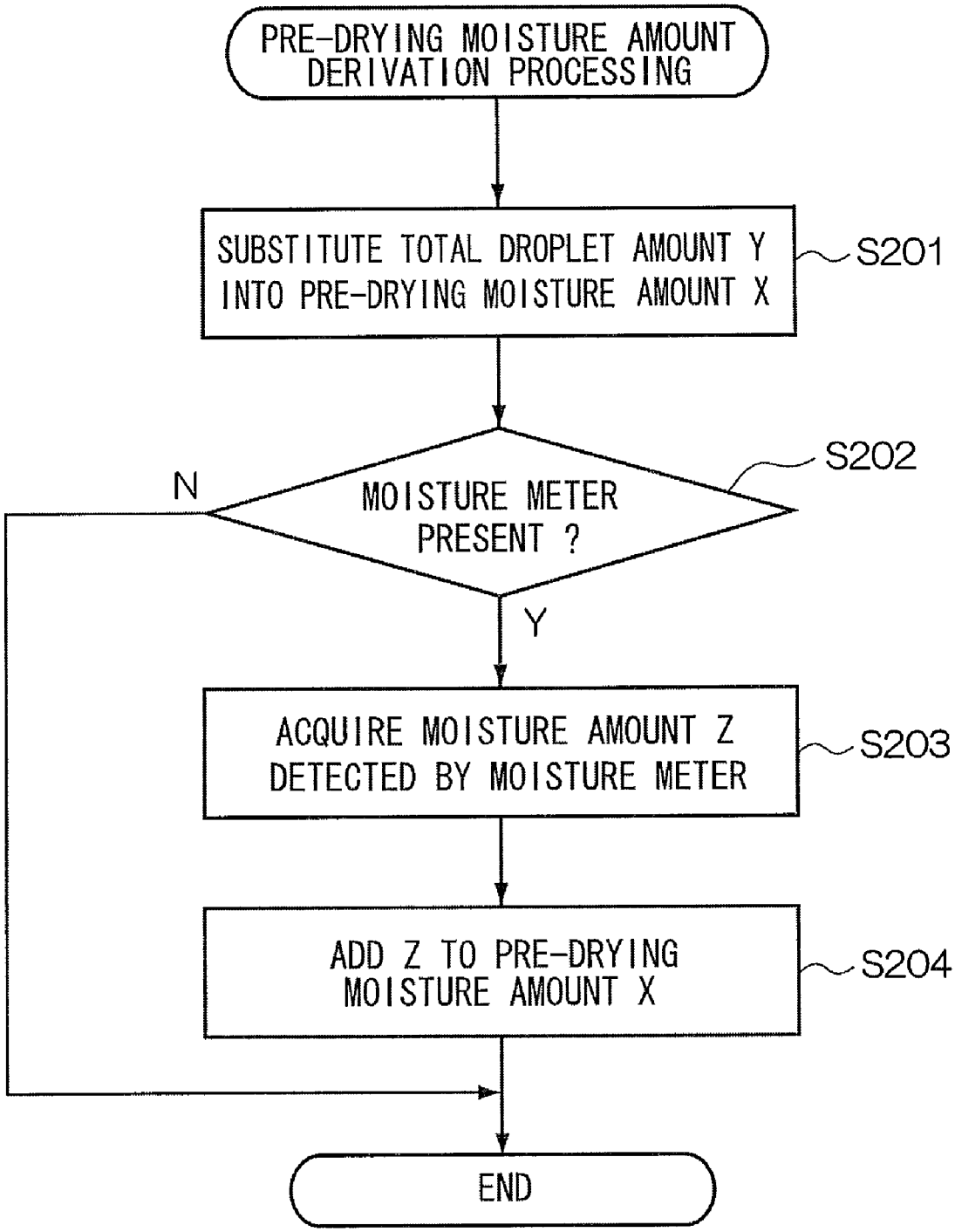
FIG. 6 is a flowchart showing pre-drying moisture amount calculation processing.

In a flow of processing of the (second) image formation processing, the pre-drying moisture amount derivation processing of step 103 illustrated in the above-described FIG. 4 is substituted with the flowchart illustrated in FIG. 6.

Firstly, in step 201, a total amount of droplets Y is assigned to the pre-drying moisture amount X. In step 202, it is judged whether or not there is a moisture meter. If this judgment is negative, the processing ends. On the other hand, if this is positive, then in step 203, a moisture amount Z detected by the moisture meter is acquired. In step 204, Z is added to the pre-drying moisture amount X, and the processing ends. The value of X derived in this manner serves as the pre-drying moisture amount.

In the above-described step 202, it is judged whether or not there is a moisture meter at the device itself. If a moisture meter is provided at the device, it is judged whether or not that moisture meter is to be used.

In the exemplary embodiment described hereabove, drying is performed uniformly over the whole paper. In such a case, drying variations (excessive drying or insufficient drying) may occur in accordance with amounts of jetted droplets.

Figure 7:
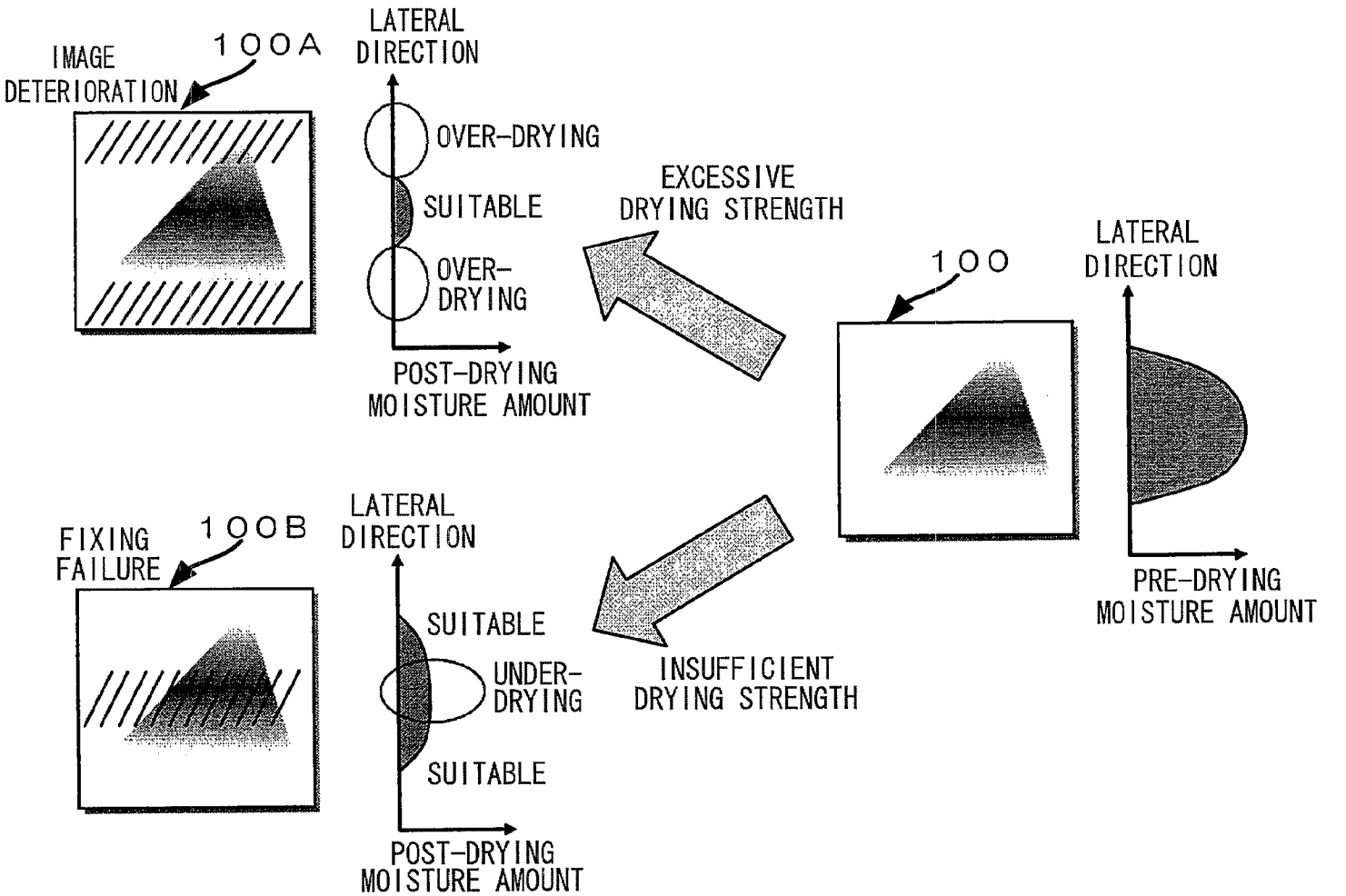
FIG. 7 is a diagram showing print variations.

A specific case of printing images 100A and 100B, which are illustrated in FIG. 7, will be described. The images 100A and 100B are images in which more droplets are jetted closer to the middle of a lateral direction of the image. With these images 100A and 100B, if the drying strength is too great, drying will be excessive at the two lateral direction ends, leading to a deterioration of image quality.

Figure 8:
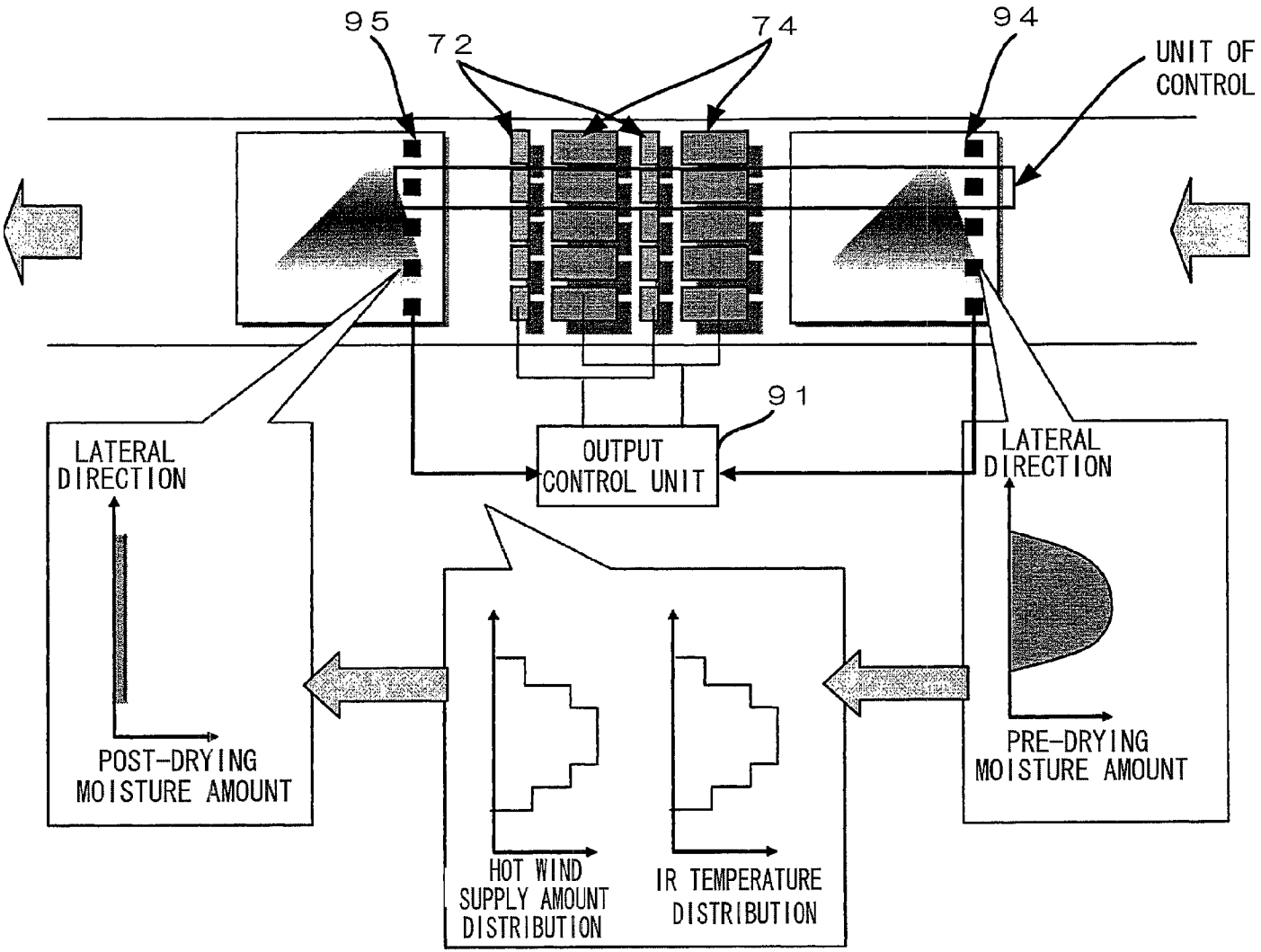
FIG. 8 is a diagram showing a structure when moisture meters and an ink drying section are plurally provided.

On the other hand, if the drying strength is too low, drying will be insufficient in the vicinity of the lateral direction middle, leading to fixing problems. Accordingly, as shown in FIG. 8, in which the image forming device 10 is viewed from above, the paper is divided into a plurality of regions. The moisture meter 94 is plurally provided (five in FIG. 8) at the respective regions to serve as meters that derive pre-drying moisture amounts of the corresponding regions. The ink drying section 18 is plurally provided at the respective regions (in FIG. 8, five pairs of each of the IR heater 74 and the hot wind nozzle 72) to serve as sections that dry the corresponding regions. On the basis of the pre-drying moisture amounts derived by the moisture meters 94 from these regions, the output control unit 91 controls the drying strengths of the ink drying sections 18 at the corresponding regions. Thus, the above-described drying variations can be suppressed. The above-described regions are regions which are separated into the plurality (five in FIG. 8) in the lateral direction of the paper, but the regions may overlap with one another.

In FIG. 8, the moisture meter 95 is also plurally provided (five in FIG. 8) at the respective regions to serve as meters that derive post-drying moisture amounts of the corresponding regions.

According to this constitution, as shown in FIG. 8, if the hot wind supply amounts and IR temperatures closer to the two lateral direction ends of the paper are lowered, the post-drying moisture amounts are appropriate and drying variations may be suppressed.

In a case of plural provision in this manner, the processing shown in the earlier described FIG. 4 is carried out separately for each set of the moisture meter 94, the moisture meter 95, the IR heaters 74 and the hot wind nozzles 72, as surrounded by a rectangle shown in FIG. 8 which indicates a unit of control.

Figure 9:
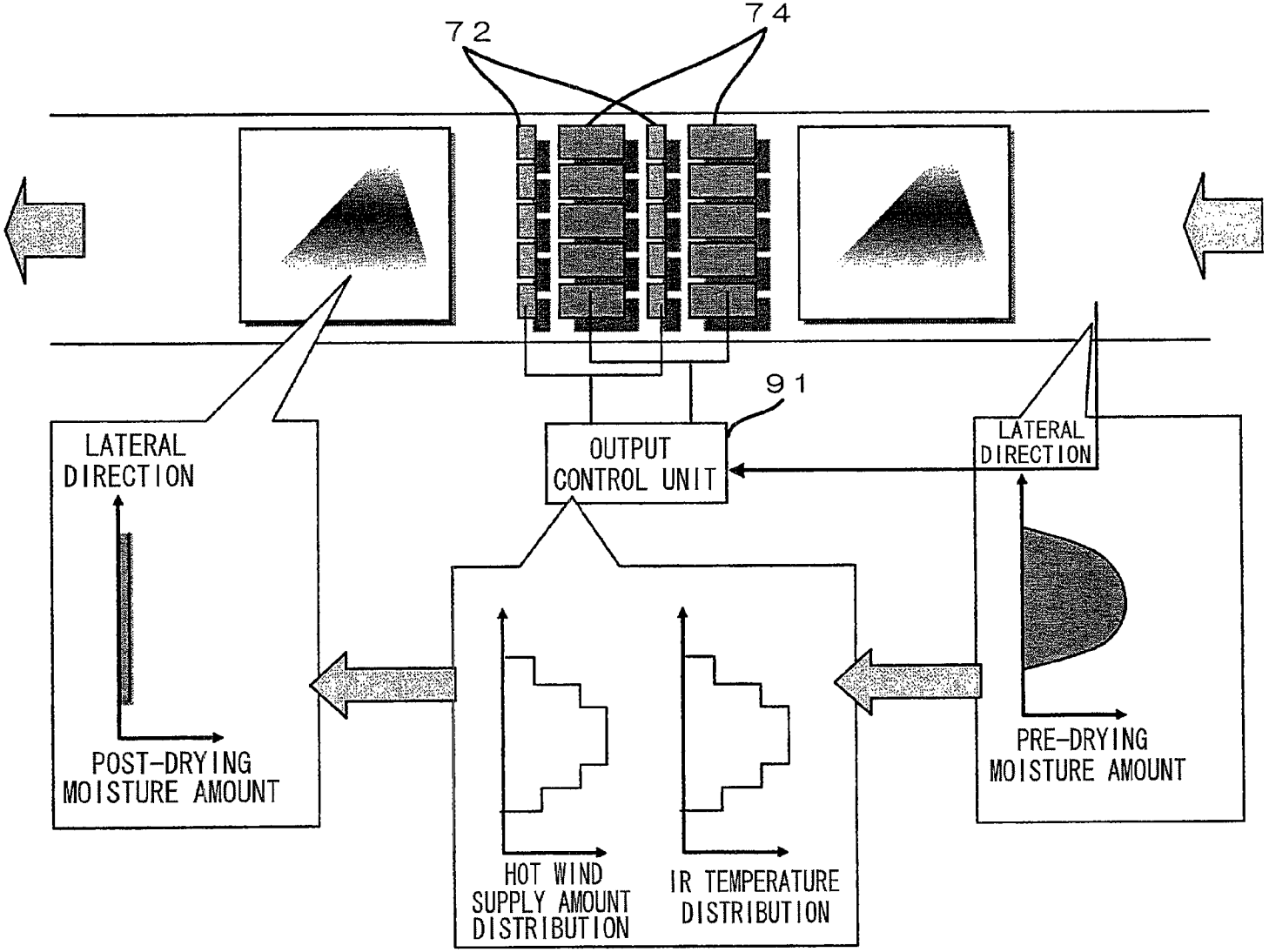
FIG. 9 is a diagram showing a structure when the ink drying section is plurally provided.

Here, if the processing illustrated in FIG. 6 that does not use a moisture meter is applied and a moisture meter that derives a post-drying moisture content is also not used, then as shown in FIG. 9, a constitution with only the IR heaters 74 and the hot wind nozzles 72 is formed.

When the moisture meter 94, the moisture meter 95, the IR heater 74 and the hot wind nozzle 72 are plurally provided in such a manner, uniform heating is possible even for images in which jetted droplet variations are very large. Consequently, drying variations within the image face may be suppressed and print quality improved.

Moreover, drying with outputs at locally required minimums in accordance with jetted droplets is possible. Therefore, electricity is not wasted at the IR heaters 74, blowers of the hot wind nozzles 72 and the like, and a saving of energy and a reduction of noise of the image forming device 10 may be achieved.

Moreover, if the paper size is changed, only a required number of the heaters arranged in the lateral direction need to be driven. Therefore, a saving of energy and a reduction of noise of the image forming device 10 may be achieved.

Comparing the exemplary embodiment described above with a conventional technology, conventional control is conducted on the basis of the temperature of a recording medium after drying or the temperature and humidity of a drying section, whereas in the present exemplary embodiment control of the drying section is conducted by direct measurements of moisture amounts after drying.

The temperature of the recording medium that is used in a conventional technology acts as a target value representing a drying condition of the recording medium. However, because drying conditions differ between types of recording medium (paper types, paper thicknesses and the like), the temperature of a recording medium is not an accurate index for representing a drying condition.

Moreover, the temperature and humidity of the drying section are affected by outside air, and similarly are not an accurate index for representing a drying condition. In contrast, in the present exemplary embodiment the moisture amount after drying is directly measured. Therefore, a drying condition of a recording medium may be accurately ascertained, and output of the drying section may be more accurately adjusted. Therefore, image quality may be improved and, at the same time, wasteful energy consumption may be reduced and energy savings realized.

In this present exemplary embodiment, even if conditions such as the type of paper, droplet application amounts and the like are variously altered, the droplets may be reliably dried without excess or insufficiency, and preparatory driving, printing for finding drying conditions and the like as in convention may be restrained. Therefore, an image forming device that provides optimum drying conditions from just after printing commences may be provided.

The flows of processing of the flowcharts described above are examples. Processing sequences may be rearranged, new steps may be added and unnecessary steps may be removed, within a scope not departing from the spirit of the present invention.

An aspect of the present invention is an image forming device including: a first moisture amount derivation component that derives a pre-drying moisture amount, which is a moisture amount contained in a recording medium after a liquid for forming an image has been applied by a liquid application component that applies the liquid to the recording medium; a drying component that dries the recording medium after the liquid has been applied to the recording medium by the liquid application component, a drying strength representing a degree of intensity with which the recording medium is dried being controlled; a storage component that stores drying information, including information representing a pre-drying moisture amount previously derived by the first moisture amount derivation component, and a drying strength of the drying component at which a recording medium was dried when the previously derived pre-drying moisture amount was derived; and a control component that controls the drying strength of the drying component on the basis of the pre-drying moisture amount derived by the first moisture amount derivation component and the drying information stored by the storage component.

In the first aspect, the first moisture amount derivation component derives a pre-drying moisture amount, which is a moisture amount contained in the recording medium after the liquid has been applied by the liquid application component, which applies the liquid for forming the image at the recording medium. The drying component dries the recording medium after the liquid has been applied to the recording medium by the liquid application component, and is capable of controlling a drying strength representing a degree of intensity with which the recording medium is dried. The storage component memorizes drying information including information representing pre-drying moisture amounts previously derived by the first moisture amount derivation component and drying strengths of the drying component with which the recording mediums were dried when those pre-drying moisture amounts were derived. The control component controls the drying strength of the drying component on the basis of the pre-drying moisture amount derived by the first moisture amount derivation component and the drying information stored by the storage component. Thus, an image forming device may be provided that is capable of accurately drying the liquid for forming the image.

A second aspect is the image forming device of the first aspect, further including a type detection component that detects a type of the recording medium, wherein the drying information further includes type information representing a type of the previously dried recording medium, and the control component controls the drying strength of the drying component on the basis of the type of the recording medium detected by the type detection component, the pre-drying moisture amount derived by the first moisture amount derivation component and the drying information stored by the storage component.

In the second aspect, because drying strengths differ between recording media, type information representing types of recording medium is further included. Thus, an image forming device may be provided that is capable of accurately drying the liquid for forming the image even with different types of recording medium.

A third aspect is the image forming device of the first aspect or the second aspect in which the first moisture amount derivation component is plurally provided, being, at each of a plurality of regions into which the recording medium is divided, a first moisture amount derivation component that derives a pre-drying moisture amount of the region, the drying component is plurally provided, being, at the each region, a drying component that dries the region, and the control component controls the drying strength of the drying component that dries the region on the basis of the pre-drying moisture amount derived by the first moisture amount derivation component from the region.

In the third aspect, because drying of the respective regions is possible, drying with outputs that are locally at the minimum required is possible. Therefore, energy consumed by the drying components is not wasted, and a saving of energy and a reduction in noise of the image forming device may be achieved. Moreover, if the size of the recording medium is changed, only a required number of the drying components arranged in the lateral direction need be driven, and thus a saving of energy and a reduction in noise of the image forming device may be achieved.

A fourth aspect is the image forming device of the third aspect in which the first moisture amount derivation component derives the pre-drying moisture amount on the basis of at least one of a moisture amount detected by a moisture detection component that detects a moisture amount contained in the recording medium, and an amount of liquid applied to the recording medium by the liquid application component.

In the fourth aspect, besides moisture amounts detected by the moisture detection component, control may be based on liquid amounts applied to recording mediums by the liquid application component. Therefore, an image forming device may be provided that is capable of accurately drying the liquid for forming the image regardless of the presence or absence of the moisture detection component.

A fifth aspect is the image forming device of the fourth aspect in which the liquid comprises at least one of an ink and an ink processing liquid.

In the fifth aspect, an ink or an ink processing liquid may be employed as the liquid.

A sixth aspect is the image forming device of any one of the first to fifth aspects, further including a second moisture amount derivation component that derives a post-drying moisture amount, which is a moisture amount contained in the recording medium that has been dried by the drying component, wherein the control component controls the drying strength of the drying component such that a post-drying moisture amount derived by the second moisture amount derivation component will be at a pre-specified moisture amount.

In the sixth aspect, the actual extent of drying may be derived. Accordingly, results of this derivation may feed back into control of the drying strength, and an image forming device may be provided that is capable of accurately drying the liquid for forming the image.

A seventh aspect is the image forming device of any one of the third to fifth aspects, further including a second moisture amount derivation component that derives a post-drying moisture amount, which is a moisture amount contained in the recording medium that has been dried by the drying component, wherein the second moisture amount derivation component is plurally provided, being, at the each region, a second moisture amount derivation component that derives a post-drying moisture amount of the region.

In the seventh aspect, the actual extent of drying may be derived for each region. Accordingly, results of these derivations may feed back into control of the drying strengths, and an image forming device may be provided that is capable of accurately drying the liquid for forming the image.

An eighth aspect is the image forming device of the sixth aspect or the seventh aspect, further including a history recording component that, when the post-drying moisture amount derived by the second moisture amount derivation component has been controlled to the pre-specified moisture amount by the control component, stores the drying information including the drying strength and the pre-drying moisture amount at the storage component as a history.

In the eighth aspect, an image forming device may be provided in which accurately drying liquid for forming a subsequent image is enabled by the recording of histories.

A ninth aspect of the present invention is an image forming method including: (a) deriving a pre-drying moisture amount, which is a moisture amount contained in a recording medium after a liquid for forming an image has been applied by a liquid application component that applies the liquid to the recording medium; (b) drying the recording medium after the liquid has been applied by the liquid application component, a drying strength representing a degree of intensity with which the recording medium is dried being controlled; and (c) controlling the drying strength in (b) on the basis of drying information, which is stored by a storage component, including information representing a pre-drying moisture amount previously derived by the first moisture amount derivation component and a drying strength of the drying component at which a recording medium was dried when the previously derived pre-drying moisture amount was derived, and the pre-drying moisture amount derived by (a).

The ninth aspect operates in the same manner as the first aspect. Therefore, the same effects as in the first aspect are provided.

A tenth aspect is the image forming method of the ninth aspect, further including (d) detecting a type of the recording medium, wherein the drying information further includes type information representing a type of the previously dried recording medium, and (c) includes controlling the drying strength in (b) on the basis of the type of recording medium detected by (d), the pre-drying moisture amount derived by (a) and the drying information.

The tenth aspect operates in the same manner as the second aspect. Therefore, the same effects as in the second aspect are provided.

An eleventh aspect is the image forming method of the ninth aspect or the tenth aspect in which (a) includes deriving, at each of a plurality of regions into which the recording medium is divided, a pre-drying moisture amount of the region, (b) includes, at the each region, drying the region, and (c) includes controlling the drying strength at which the region is dried in (b) on the basis of the pre-drying moisture amount derived by (a) from the region.

The eleventh aspect operates in the same manner as the third aspect. Therefore, the same effects as in the third aspect are provided.

A twelfth aspect is the image forming method of the eleventh aspect in which (a) includes deriving the pre-drying moisture amount on the basis of at least one of a moisture amount detected by a moisture detection component that detects a moisture amount contained in the recording medium, and an amount of liquid applied to the recording medium by the liquid application component.

The twelfth aspect operates in the same manner as the fourth aspect. Therefore, the same effects as in the fourth aspect are provided.

A thirteenth aspect is the image forming method of the twelfth aspect in which the liquid includes at least one of an ink and an ink processing liquid.

The thirteenth aspect operates in the same manner as the fifth aspect. Therefore, the same effects as in the fifth aspect are provided.

A fourteenth aspect is the image forming method of any of the ninth aspect to the thirteenth aspect, further including (e) deriving a post-drying moisture amount, which is a moisture amount contained in the recording medium that has been dried by (b), wherein (c) includes controlling the drying strength in (b) such that a post-drying moisture amount derived by (e) will be at a pre-specified moisture amount.

The fourteenth aspect operates in the same manner as the sixth aspect. Therefore, the same effects as in the sixth aspect are provided.

A fifteenth aspect is the image forming method of any of the eleventh aspect to the thirteenth aspect, further including (f) deriving a post-drying moisture amount, which is a moisture amount contained in the recording medium that has been dried by (b), wherein (f) includes deriving, at the each region, a post-drying moisture amount of the region.

The fifteenth aspect operates in the same manner as the seventh aspect. Therefore, the same effects as in the seventh aspect are provided.

A sixteenth aspect is the image forming method of any of the eleventh aspect to the thirteenth aspect, further including (g), when the post-drying moisture amount derived by (f) has been controlled to the pre-specified moisture amount by (c), storing the drying information including the drying strength and the pre-drying moisture amount at the storage component as a history.

The sixteenth aspect operates in the same manner as the eighth aspect. Therefore, the same effects as in the eighth aspect are provided.

According to the present invention, an image forming device and image forming method capable of accurately drying a liquid for forming images may be provided.

What is claimed is:

1. An image forming device comprising:

a first moisture amount derivation component that derives a pre-drying moisture amount, which is a moisture amount contained in a recording medium after a liquid for forming an image has been applied by a liquid application component that applies the liquid to the recording medium;

a drying component that dries the recording medium after the liquid has been applied to the recording medium by the liquid application component, a drying strength representing a degree of intensity with which the recording medium is dried being controlled;

a storage component that stores drying information, including information representing a pre-drying moisture amount previously derived by the first moisture amount derivation component, and a drying strength of the drying component at which a recording medium was dried when the previously derived pre-drying moisture amount was derived; and a control component that controls the drying strength of the drying component on the basis of the pre-drying moisture amount derived by the first moisture amount derivation component and the drying information stored by the storage component.

2. The image forming device of claim 1, further comprising a type detection component that detects a type of the recording medium, wherein the drying information further includes type information representing a type of a recording medium, and the control component controls the drying strength of the drying component on the basis of the type of the recording medium detected by the type detection component, the pre-drying moisture amount derived by the first moisture amount derivation component and the drying information stored by the storage component.

3. The image forming device of claim 1, wherein the first moisture amount derivation component is plurally provided, being, at each of a plurality of regions into which the recording medium is divided, a first moisture amount derivation component that derives a pre-drying moisture amount of the region, the drying component is plurally provided, being, at each region, a drying component that dries the region, and the control component controls the drying strength of the drying component that dries the region on the basis of the pre-drying moisture amount derived by the first moisture amount derivation component from the region.

4. The image forming device of claim 3, wherein the first moisture amount derivation component derives the pre-drying moisture amount on the basis of at least one of a moisture amount detected by a moisture detection component that detects a moisture amount contained in the recording medium, and an amount of liquid applied to the recording medium by the liquid application component.

5. The image forming device of claim 4, wherein the liquid comprises at least one of an ink and an ink processing liquid.

6. The image forming device of claim 1, further comprising a second moisture amount derivation component that derives a post-drying moisture amount, which is a moisture amount contained in the recording medium that has been dried by the drying component, wherein the control component controls the drying strength of the drying component such that a post-drying moisture amount derived by the second moisture amount derivation component will be at a pre-specified moisture amount.

7. The image forming device of claim 6, further comprising a history recording component that, when the post-drying moisture amount derived by the second moisture amount derivation component has been controlled to the pre-specified moisture amount by the control component, stores the drying information including the drying strength and the pre-drying moisture amount at the storage component as a history.

8. The image forming device of claim 3, further comprising a second moisture amount derivation component that derives a post-drying moisture amount, which is a moisture amount contained in the recording medium that has been dried by the drying component, wherein the second moisture amount derivation component is plurally provided, being, at the each region, a second moisture amount derivation component that derives a post-drying moisture amount of the region.

9. The image forming device of claim 8, further comprising a history recording component that, when the post-drying moisture amount derived by the second moisture amount derivation component has been controlled to the pre-specified moisture amount by the control component, stores the drying information including the drying strength and the pre-drying moisture amount at the storage component as a history.

10. An image forming method comprising:

(a) deriving a pre-drying moisture amount, which is a moisture amount contained in a recording medium after a liquid for forming an image has been applied by a liquid application component that applies the liquid to the recording medium;

(b) drying the recording medium after the liquid has been applied by the liquid application component, a drying strength representing a degree of intensity with which the recording medium is dried being controlled; and (c) controlling the drying strength in (b) on the basis of drying information, which is stored by a storage component, including information representing a pre-drying moisture amount previously derived by the first moisture amount derivation component and a drying strength of the drying component at which a recording medium was dried when the pre-drying moisture amount was derived, and the pre-drying moisture amount derived by (a).

11. The image forming method of claim 10, further comprising (d) detecting a type of the recording medium, wherein the drying information further includes type information representing a type of the recording medium, and (c) includes controlling the drying strength in (b) on the basis of the type of recording medium detected by (d), the pre-drying moisture amount derived by (a) and the drying information.

12. The image forming method of claim 10, wherein (a) includes deriving, at each of a plurality of regions into which the recording medium is divided, a pre-drying moisture amount of the region, (b) includes, at the each region, drying the region, and (c) includes controlling the drying strength at which the region is dried in (b) on the basis of the pre-drying moisture amount derived by (a) from the region.

13. The image forming method of claim 12, wherein (a) includes deriving the pre-drying moisture amount on the basis of at least one of a moisture amount detected by a moisture detection component that detects a moisture amount contained in the recording medium, and an amount of liquid applied to the recording medium by the liquid application component.

14. The image forming method of claim 13, wherein the liquid includes at least one of an ink and an ink processing liquid.

15. The image forming method of claim 10, further comprising (e) deriving a post-drying moisture amount, which is a moisture amount contained in the recording medium that has been dried by (b), wherein (c) includes controlling the drying strength in (b) such that a post-drying moisture amount derived by (e) will be at a pre-specified moisture amount.

16. The image forming method of claim 15, further comprising (g), when the post-drying moisture amount derived by (e) has been controlled to the pre-specified moisture amount by (c), storing the drying information including the drying strength and the pre-drying moisture amount at the storage component as a history.

17. The image forming method of claim 12, further comprising (f) deriving a post-drying moisture amount, which is a moisture amount contained in the recording medium that has been dried by (b), wherein (f) includes deriving, at the each region, a post-drying moisture amount of the region.

18. The image forming method of claim 17, further comprising (g), when the post-drying moisture amount derived by (f) has been controlled to the pre-specified moisture amount by (c), storing the drying information including the drying strength and the pre-drying moisture amount at the storage component as a history.

* * * * *